United States Patent [19]

Fricke et al.

[11] 3,972,642

[45] Aug. 3, 1976

[54] GAS TURBINE

[75] Inventors: Hans Fricke, Oberstedten; Hans Schümmer, Oberursel, both of Germany

[73] Assignee: Klockner-Humboldt-Deutz Aktiengesellschaft, Cologne, Germany

[22] Filed: Feb. 28, 1975

[21] Appl. No.: 553,883

[30] Foreign Application Priority Data

Mar. 2, 1974 Germany ..... 2410139

[52] U.S. Cl. ..... 415/145; 415/158

[51] Int. Cl.[2] ..... F04D 27/00

[58] Field of Search ..... 415/148, 158, 126, 157, 415/144, 145

[56] References Cited

UNITED STATES PATENTS

| | | | |
|---|---|---|---|
| 1,085,045 | 1/1914 | Holzapfel | 415/158 |
| 2,015,502 | 9/1935 | Taumpler | 415/145 |
| 2,435,836 | 2/1948 | Johnson | 415/158 |

FOREIGN PATENTS OR APPLICATIONS

| | | | |
|---|---|---|---|
| 62,366 | 6/1944 | Denmark | 415/158 |
| 542,221 | 4/1956 | Italy | 415/158 |
| 643,530 | 9/1950 | United Kingdom | 415/158 |

*Primary Examiner*—Henry F. Raduazo
*Attorney, Agent, or Firm*—Walter Becker

[57] ABSTRACT

A gas turbine with a centrifugal compressor as generator for compressed air and with a withdrawal of compressed air for outside use, according to which within the region of the withdrawal area at the compressed air passage there is provided an adjustable flow divider which during the withdrawal of compressed air divides the oncoming quantity of air into a withdrawal quantity and a gas turbine quantity.

5 Claims, 2 Drawing Figures

GAS TURBINE

The present invention relates to a gas turbine with a centrifugal compressor as compressed air generator and with a compressed air withdrawal for external use.

With gas turbines of this type, during the temporary compressed air withdrawal, principally a pressure drop occurs. In order to keep this pressure drop at a minimum with some gas turbines adjustable guiding vanes or turbine blades are provided. This arrangement, however, requires a generally undesired great number of parts and a complicated construction.

It is also known to provide gas turbines with a throttle interposed between the compressed air withdrawal station and the turbine each time when a compressed air withdrawal takes place. The arrangement of the throttle is also able to prevent a pressure drop, however, only when the throttle cross section is precisely controlled in conformity with the opening cross section of the withdrawal valve. To this end, an additional device is necessary which greatly increases the expenses for the construction of such device.

It is, therefore, an object of the present invention to provide a gas turbine which will obviate the above mentioned drawbacks and will make it possible to provide an air withdrawing device which during the withdrawal of a partial quantity of air will prevent the otherwise occurring drop in the compressed air.

Figure 1:
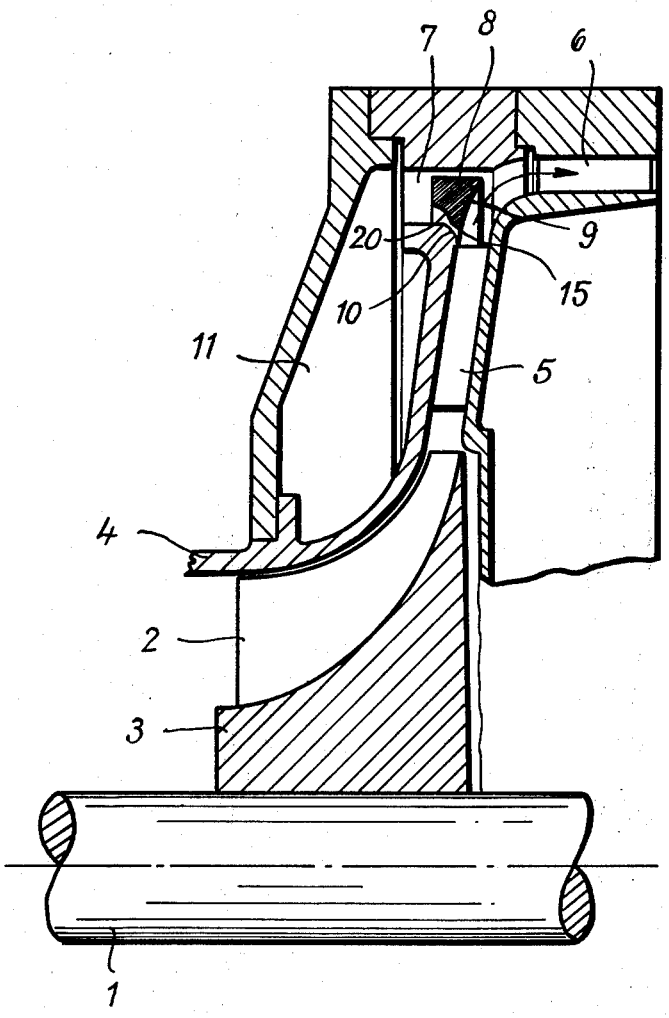

These and other objects and advantages of the invention will appear more clearly from the following specification, in connection with the accompanying drawings, in which:

FIG. 1 diagrammatically illustrates a section through a part of a gas turbine and, more specifically, through a centrifugal compressor and a flow divider according to the invention.

Figure 2:
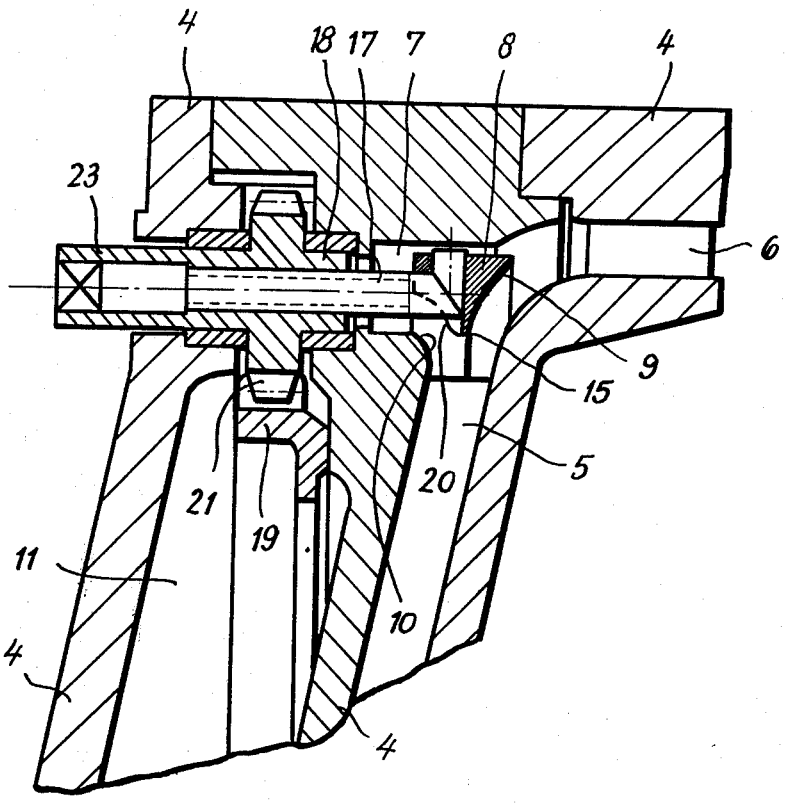

FIG. 2 represents a section similar to that of FIG. 1 which also shows an adjusting device.

The gas turbine according to the invention which is provided with a centrifugal compressor as compressed air generator, and is furthermore provided with a compressed air withdrawal, is characterized primarily in that within the region of the withdrawal area an adjustable flow divider is arranged in the compressed air passage, which flow divider will during the withdrawal of compressed air divide the oncoming quantity of air into a withdrawal quantity and a gas turbine quantity.

This arrangement of the flow divider prevents a drop in the air pressure which normally occurs when withdrawing partial quantities of air.

For a gas turbine with an annular compressed air conveying passage, it is suggested that the flow divider comprises an adjusting ring with approximately triangular cross section, which divider ring is displaceable transverse to the compressed air passage into the flow cross section. This arrangement can with a gas turbine provided with at least one radial compressor stage and as the case may be with a radial exit distributor or diffuser, followed by a cylindrical compressed air passage through a deviation, be realized in an advantageous manner when within the region of the deviation in opposite direction of the annular compressed air passage an air withdrawal ring passage follows and when the annular flow divider is mounted in the air withdrawal ring passage and is displaceable parallel thereto. These features according to the present invention make it possible to employ a one-part rigid flow divider which is simple to manufacture. In order to exert its effect, the flow divider need merely to be displaced coaxially with regard to the annular passage. In order by the installation of the flow divider, to favorably design the flow conditions in the compressed air annular passage, it is furthermore suggested that at least that side of the flow divider which faces the annular passage for the compressed air is, when viewed in section, arc-shaped in conformity with the deviation. The flow divider is held by threaded spindles which cooperate with spindle nuts rotatably journaled in the housing. Each of the spindle nuts has an outer tooth and meshes with a central gear. As a result thereof, a uniform adjustmemt of all nuts and threaded spindles will be obtained.

In order by actuating one part only, to bring about an adjustment of all adjustable parts referred to above, it is suggested that one of the spindle nuts has an extension projecting from the housing by means of which extension the adjustment of the flow divider is initiated.

Referring now to the drawings in detail, the gas turbine illustrated in FIG. 1 comprises a shaft 1 having mounted thereon a runner 3 with vanes 2. Adjacent said runner 3 there is provided a housing 4 with an outlet distributor or connecting means 5. The compressed air leaving the outlet distributor 5 is, as indicated by the arrow, deviated in the housing from the substantially radial direction to an axial direction. This deviation is followed by an annular compressed air passage 6 which leads to a non-illustrated combustion chamber of the gas turbine. Opposite said passage 6 there is provided an air withdrawing annular passage 7 having arranged therein a flow divider 8 during the operation without air withdrawal. That side 9 of the flow divider 8 which faces the annular compresed air passage 6 is carefully adapted to the contour of the flow passage in order to avoid losses.

According to the arrangment of FIG. 2, the flow divider 8 is in the air withdrawal position and brings about the division of the air quantity coming from the compressor. The proportion of air to be withdrawn will, due to the flow favorable design of a contour 20 on that side of the flow divider 8 which faces the annular air withdrawing passage 7, and in view of a rounding 10 on housing 4, without any material losses, be conveyed through the annular air withdrawing passage 7 into a collecting chamber 11 for the withdrawn air, said chamber being arranged in housing 4. The displacement of the flow divider 8 in the direction of the annular passage 6 for the compressed air brings about a constriction of the flow passage leading to the combustion chamber so that the previously set pressure will be retained. A good degree of efficiency of the flow divider 8 is furthermore brought about by a sharp edge 15 provided between the side 9 and the contour 20.

The flow divider 8 is at several places of the circumference suspended on a radially outwardly bent end of threaded spindles 17 and can be axially displaced by said spindles 17. The threaded spindles 17 move in spindle nuts 18 which latter are provided with outer teeth 21.

For actuating flow divider 8, a rotary movement is initiated by means of an extension 23 of a spindle nut 18, which extension passes through the air withdrawing chamber 11 toward the outside. This rotary movement is conveyed through the intervention of the outer teeth 21 cut into the spindle nut 18 and through the intervention of a central gear 19 is conveyed simultaneously to the other spindle nuts 18.

In conformity with the rotation of the spindle nuts 18, the threaded spindles 17 are screwed out or screwed in so that the flow divider 8 suspended on the outwardly bent ends of the threaded spindles 17 is displaced in an axial direction. Due to the suspension of the flow divider 8 on the outwardly bent ends of the threaded spindles 17, the spindles 17 are, in a simple manner, prevented from rotation. Moreover, the annular flow divider 8 can when being subjected to heat expand without force.

It is, of course, to be understood that the present invention is, by no means, limited to the specific showing in the drawings, but also comprises any modifications within the scope of the appended claims.

What we claim is:

1. A gas turbine which includes in combination: compressed air generating means, conduit means for receiving compressed air and conveying same to a combustion chamber, connecting means interposed and establishing communication between said conduit means and said compressed air generating means, compressed air withdrawing means arranged for communication with said connecting means, flow dividing means arranged in a portion of said air withdrawing means and adjustable selectively to extend into said connecting means to thereby divide the flow of compressed air passing through said connecting means into a first quantity to pass to said conduit means and a second quantity to pass into said compressed air withdrawing means while simultaneously creating a constriction in said connecting means ahead of said conduit means to prevent any material pressure drop in the air passing from said connecting means into said conduit means, said conduit means forming an annular passage, said flow dividing means including a distributing ring of an approximately triangular cross section selectively movable into said connecting means in a direction approximately transverse thereto only then when compressed air withdrawal occurs, housing means confining said compressed air withdrawing means, threaded spindle means operatively connected to take hold of said distributing ring for displacing the same, and nut means rotatably but axially non-displaceably mounted in said means and operatively in mesh with said threaded spindle means.

2. A gas turbine according to claim 1, in which said air generating means comprises at least one radial compressor stage, and in which said connecting means includes a curved section adjacent said distributing ring, said compressed air withdrawing means including an annular section having said flow dividing means displaceably arranged therein.

3. A gas turbine according to claim 2, in which the triangular cross section of said distributing ring has the side thereof which faces toward said curved section curved in conformity with the curvature of the latter.

4. A gas turbine which includes: compressed air generating means, conduit means for receiving compressed air and conveying same to a combustion chamber, connecting means interposed and establishing communication between said conduit means and said compressed air generating means, compressed air withdrawing means arranged for communication with said connecting means, flow dividing means arranged in a portion of said air withdrawing means and adjustable selectively to extend into said connecting means to thereby divide the flow of compressed air passing through said connecting means into a first quantity to pass to said conduit means and a second quantity to pass into said compressed air withdrawing means while simultaneously creating a constriction in said connecting means ahead of said conduit means to prevent any material pressure drop in the air passing from said connecting means into said conduit means, said conduit means forming an annular passage, said flow dividing means including a distributing ring of an approximately triangular cross section selectively movable into said connecting means in a direction approximately transverse thereto, housing means confining said compressed air withdrawing means, threaded spindle means operatively connected to said distributing ring for displacing the same, nut means rotatably but axially non-displaceably mounted in said housing means and in mesh with said threaded spindle means, said nut means comprising a plurality of spindle nuts with outer teeth, and a central gear in mesh with said spindle nuts.

5. A gas turbine according to claim 4, in which one of said spindle nuts has an extension projecting from said housing means and being operable from the outside of said housing means for actuating said last mentioned spindle nut and thereby through the intervention of said central gear also the other spindle nuts.

* * * * *